US011472003B2

(12) United States Patent
Hsu

(10) Patent No.: US 11,472,003 B2
(45) Date of Patent: Oct. 18, 2022

(54) SELF-CENTERING VISE STRUCTURE

(71) Applicant: Wei-Chieh Hsu, Taichung (TW)

(72) Inventor: Wei-Chieh Hsu, Taichung (TW)

( * ) Notice: Subject to any disclaimer, the term of this patent is extended or adjusted under 35 U.S.C. 154(b) by 114 days.

(21) Appl. No.: 17/001,829

(22) Filed: Aug. 25, 2020

(65) Prior Publication Data

US 2021/0107117 A1 Apr. 15, 2021

(30) Foreign Application Priority Data

Oct. 14, 2019 (TW) ..... 108213501

(51) Int. Cl.
*B25B 1/10* (2006.01)
*B25B 1/24* (2006.01)

(52) U.S. Cl.
CPC ..... *B25B 1/103* (2013.01); *B25B 1/2457* (2013.01); *B25B 1/2478* (2013.01); *B25B 1/2405* (2013.01)

(58) Field of Classification Search
CPC ..... B25B 1/103; B25B 1/2457; B25B 1/24; B25B 1/2405; B25B 1/241; B25B 1/2473; B25B 1/2478; B25B 1/2489
USPC ..... 269/43, 154, 242
See application file for complete search history.

(56) References Cited

U.S. PATENT DOCUMENTS 4,861,010 A * 8/1989 Neil ..... B25B 1/2452 269/282
2014/0131933 A1* 5/2014 Taylor ..... B25B 1/24 269/265
2017/0001284 A1* 1/2017 Maggert ..... B25B 1/103
2018/0272499 A1* 9/2018 Cheng ..... B25B 1/2489
2021/0107117 A1* 4/2021 Hsu ..... B25B 1/2457

FOREIGN PATENT DOCUMENTS

DE 10241815 * 3/2004
TW M518608 * 3/2016
TW M518608 U 3/2016

* cited by examiner

*Primary Examiner* — Mahdi H Nejad
(74) *Attorney, Agent, or Firm* — Alan D. Kamrath; Karin L. Williams; Mayer & Williams PC

(57) ABSTRACT

A self-centering vise structure includes a vise body, a guide screw, a positioning unit, a first movable jaw unit, and a second movable jaw unit. The vise body is provided with a guide way. The positioning unit is provided with two fixed portions each provided with an elongate slot. The positioning unit is provided with two locking screws each extending through the elongate slot of each of the two fixed portions and is screwed into the guide way of the vise body. The elongate slot of each of the two fixed portions is moved relative to each of the two locking screws, and the positioning unit is moved relative to the vise body, to micro-adjust a central location of the self-centering vise structure.

12 Claims, 6 Drawing Sheets

SELF-CENTERING VISE STRUCTURE

BACKGROUND OF THE INVENTION

1. Field of the Invention

The present invention relates to a tool and, more particularly, to a self-centering vise structure.

2. Description of the Related Art

A conventional self-centering vise structure was disclosed in the Taiwanese Patent Publication No. M518608, and comprises a vise body, a guide screw, a positioning unit, a first jaw unit, a second jaw unit, and multiple set screws. The vise body is provided with a guide way. The guide screw has a first end provided with a first external thread and a second end provided with a second external thread. The guide screw has a middle provided with a positioning flange. The positioning unit is mounted on the positioning flange of the guide screw. The first movable jaw unit is slidably mounted in the guide way of the vise body. The first movable jaw unit is provided with a first internal thread corresponding to the first external thread of the guide screw. The second movable jaw unit is slidably mounted in the guide way of the vise body. The second movable jaw unit is provided with a second internal thread corresponding to the second external thread of the guide screw. When the guide screw is rotated, the first movable jaw unit and the second movable jaw unit are moved simultaneously to perform a clamping action or a loosening action. The positioning unit includes an upper positioning piece and a lower positioning piece. The lower positioning piece has multiple connecting holes. The upper positioning piece has multiple screw holes corresponding to the connecting holes. The vise body has multiple apertures. The set screws extend through the apertures of the vise body and the connecting holes of the lower positioning piece and are screwed into the screw holes of the upper positioning piece, to affix the positioning unit to the vise body. In use, when the conventional self-centering vise structure is operated during a period of time, the center location is displaced and has to be adjusted. However, the positioning unit is affixed to the vise body such that the location of the positioning unit is fixed and cannot be adjusted for regulating the center location of the conventional self-centering vise structure, thereby greatly decreasing the working precision thereof.

BRIEF SUMMARY OF THE INVENTION

The primary objective of the present invention is to provide a self-centering vise structure having a center adjustment function.

In accordance with the present invention, there is provided a self-centering vise structure comprising a vise body, a guide screw, a positioning unit, a first movable jaw unit, and a second movable jaw unit. The vise body is provided with a guide way. The guide screw has a first end provided with a first external thread and a second end provided with a second external thread. The guide screw has a middle provided with a positioning flange. The positioning flange has an annular shape. The positioning unit is mounted on the positioning flange of the guide screw. The first movable jaw unit is slidably mounted in the guide way of the vise body. The first movable jaw unit is provided with a first internal thread corresponding to the first external thread of the guide screw. The second movable jaw unit is slidably mounted in the guide way of the vise body. The second movable jaw unit is provided with a second internal thread corresponding to the second external thread of the guide screw. When the guide screw is rotated, the first movable jaw unit and the second movable jaw unit are moved simultaneously to perform a clamping action or a loosening action. The positioning unit is provided with two fixed portions. Each of the two fixed portions of the positioning unit is provided with an elongate slot. The positioning unit is provided with two locking screws. Each of the two locking screws extends through the elongate slot of each of the two fixed portions and is screwed into the guide way of the vise body. The positioning unit includes a first positioning block and a second positioning block. The first positioning block and the second positioning block are combined together by screwing. The positioning unit is provided with a positioning groove mounted on the positioning flange of the guide screw. The positioning groove of the positioning unit has an annular shape. The elongate slot of each of the two fixed portions is moved relative to each of the two locking screws, and the positioning unit is moved relative to the vise body, to micro-adjust a central location of the self-centering vise structure.

According to the primary advantage of the present invention, after each of the two locking screws is unscrewed from each of the two screw holes of the vise body, the elongate slot of each of the two fixed portions is moved relative to each of the two locking screws, such that the positioning unit is moved forward or backward relative to the vise body, to exactly micro-adjust the centrality of the self-centering vise structure.

According to another advantage of the present invention, each of the two locking screws is screwed into each of the two screw holes of the vise body to locate the positioning unit, and is unscrewed from each of the two screw holes of the vise body to adjust the positioning unit, such that the positioning unit is positioned and adjusted easily and rapidly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
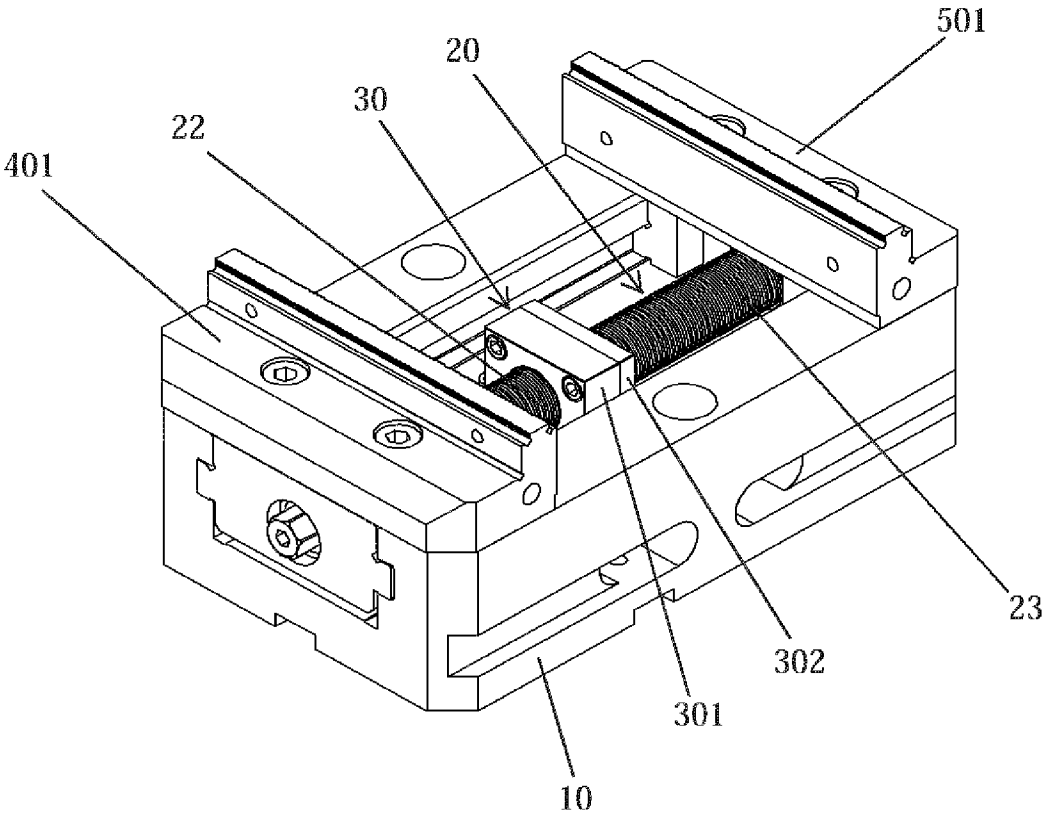
FIG. 1 is a perspective view of a self-centering vise structure in accordance with the preferred embodiment of the present invention.
Figure 2:
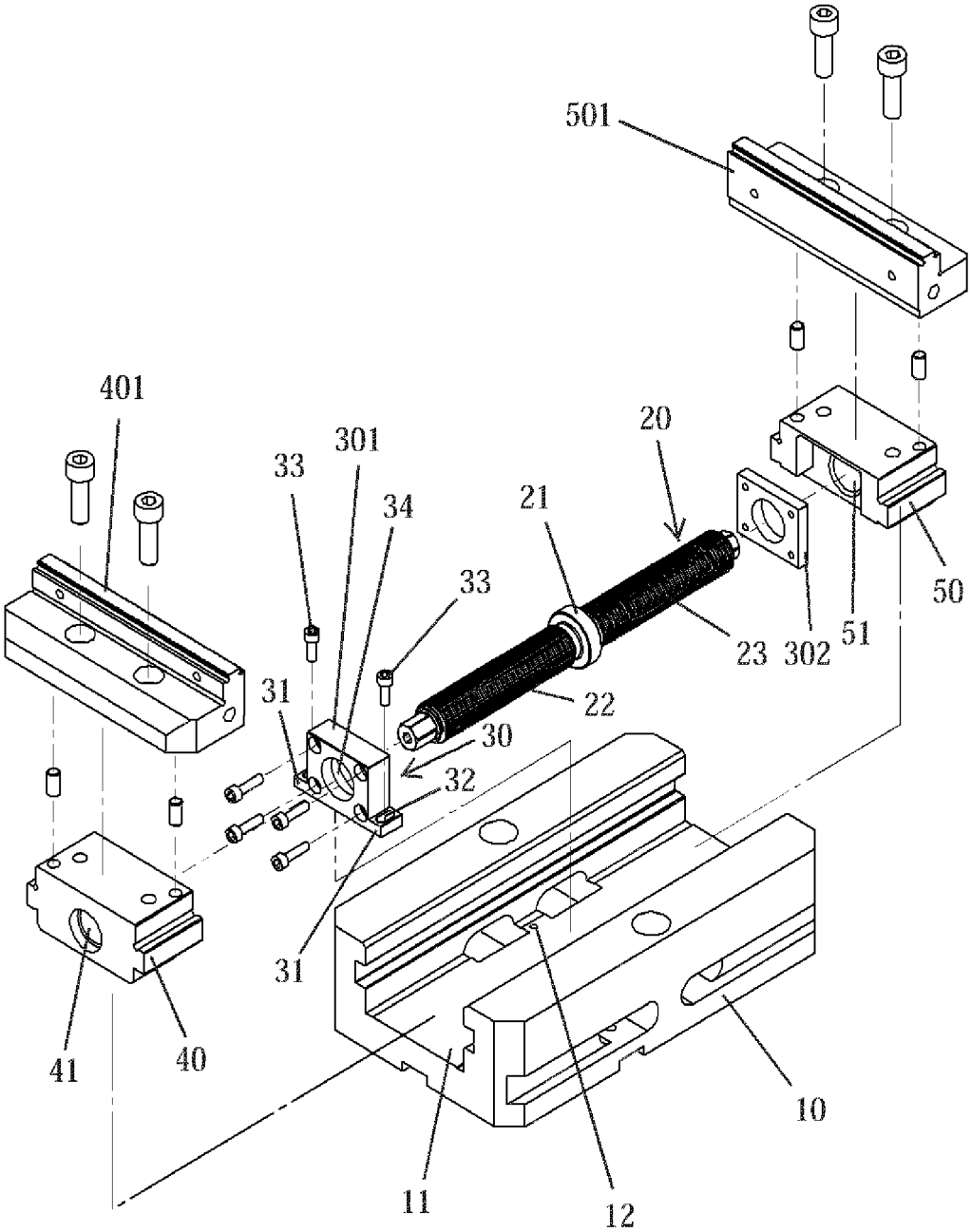
FIG. 2 is an exploded perspective view of the self-centering vise structure in accordance with the preferred embodiment of the present invention.
Figure 3:
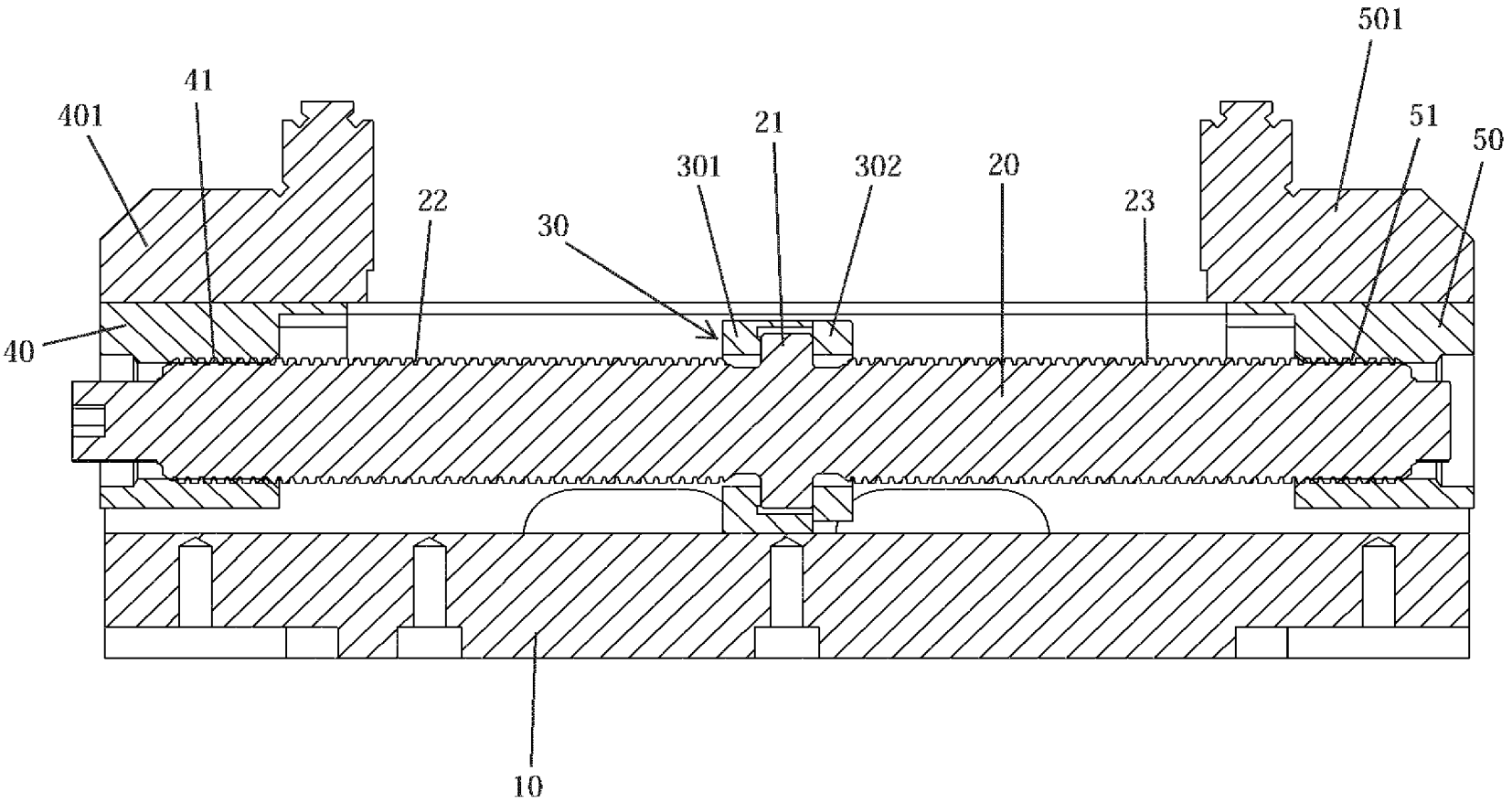
FIG. 3 is a side cross-sectional view of the self-centering vise structure as shown in FIG. 1.
Figure 4:
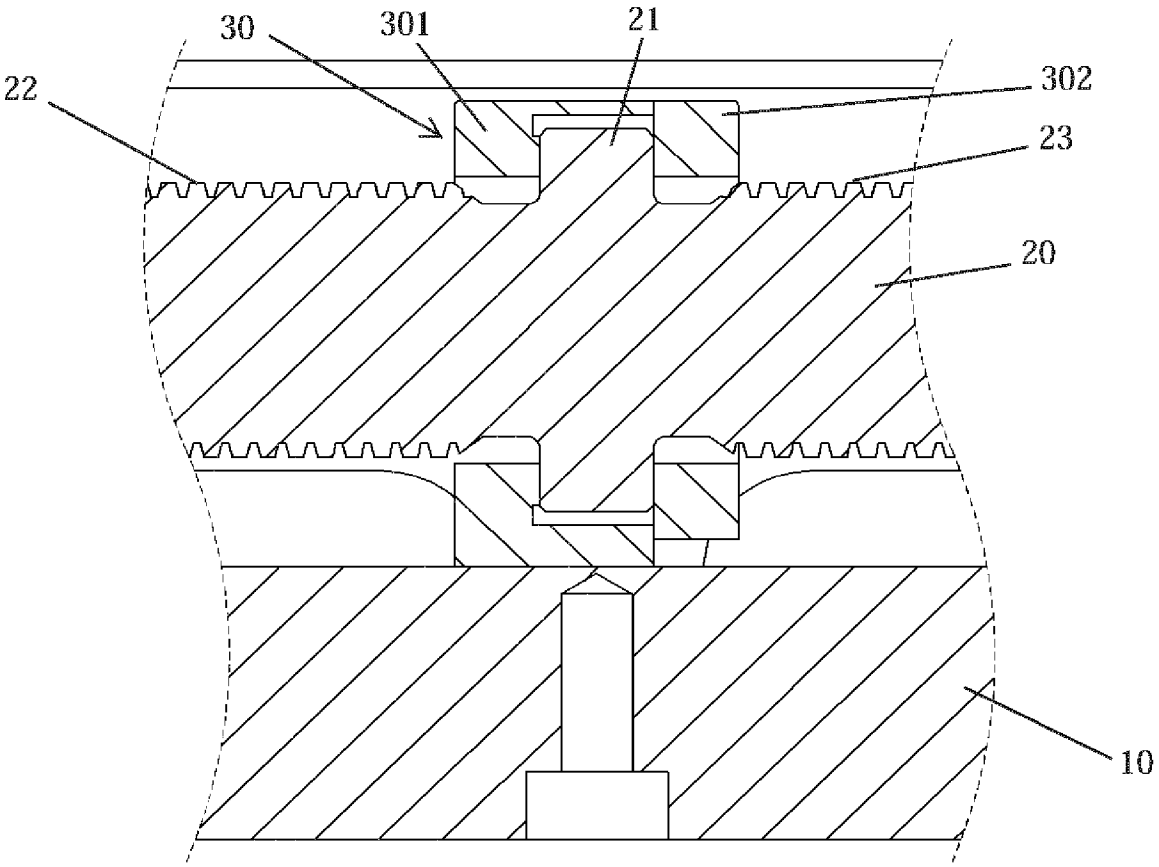
FIG. 4 is a locally enlarged view of the self-centering vise structure as shown in FIG. 3.
Figure 5:
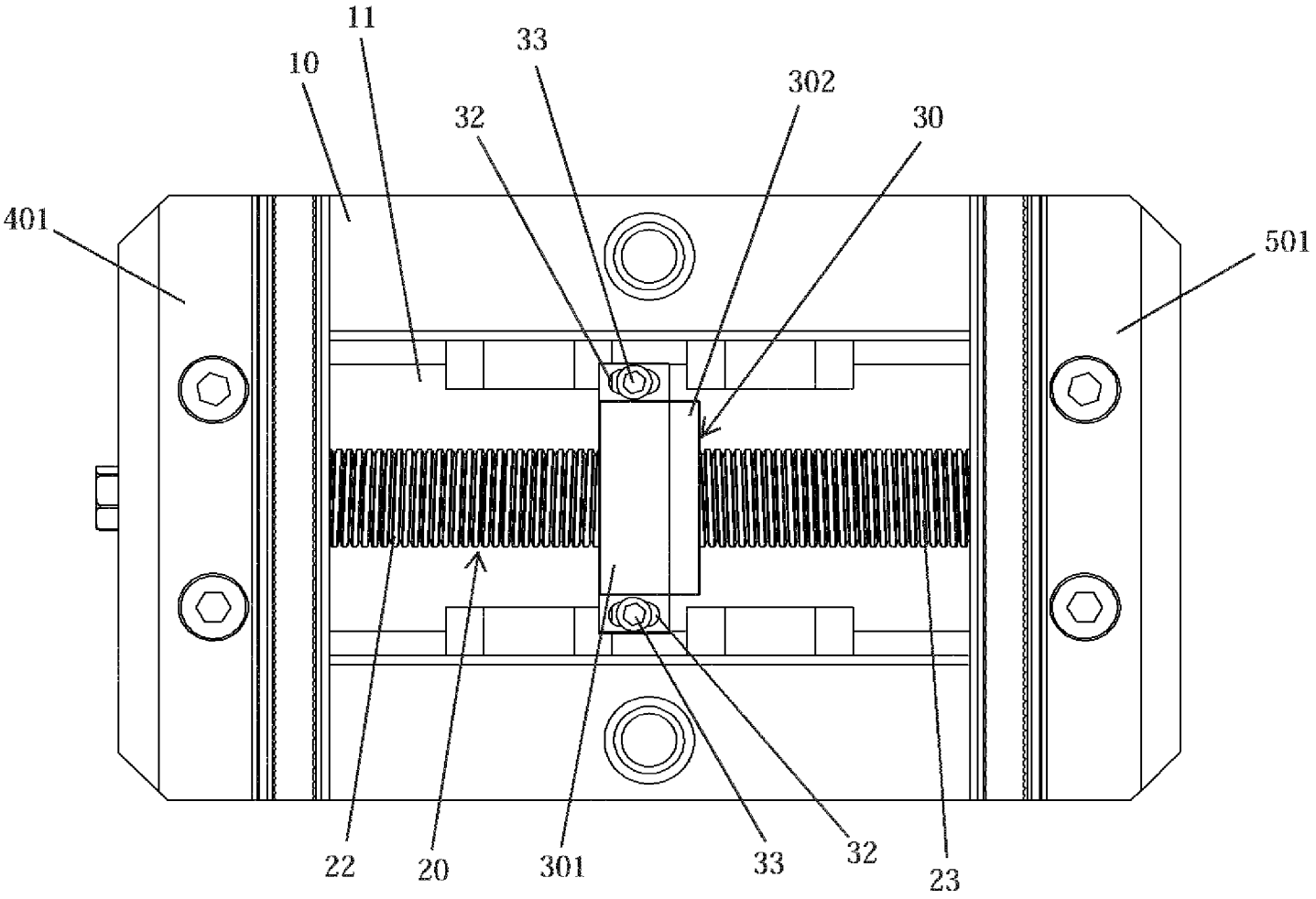
FIG. 5 is a top view of the self-centering vise structure as shown in FIG. 1.

Referring to FIGS. 1-6, a self-centering vise structure in accordance with the present invention comprises a vise body 10, a guide screw 20, a positioning unit 30, a first movable jaw unit 40, and a second movable jaw unit 50.

The vise body 10 is provided with a guide way 11. The guide screw 20 has a first end provided with a first (or positive) external thread 22 and a second end provided with a second (or reverse) external thread 23. The second external thread 23 has a threading direction different from that of the first external thread 22. The guide screw 20 has a middle provided with a positioning flange (or projection) 21. The positioning flange 21 has an annular shape and is located between the first external thread 22 and the second external thread 23. The positioning unit 30 is mounted on the positioning flange 21 of the guide screw 20. The first movable jaw unit 40 is slidably mounted in the guide way 11 of the vise body 10. The first movable jaw unit 40 is provided with a first (or positive) internal thread 41 corresponding to the first external thread 22 of the guide screw 20. The second movable jaw unit 50 is slidably mounted in the guide way 11 of the vise body 10. The second movable jaw unit 50 is provided with a second (or reverse) internal thread 51 corresponding to the second external thread 23 of the guide screw 20. The second internal thread 51 has a threading direction different from that of the first internal thread 41. Thus, when the guide screw 20 is rotated, the first movable jaw unit 40 and the second movable jaw unit 50 are moved simultaneously to perform a clamping action or a loosening action.

In the preferred embodiment of the present invention, the positioning unit 30 is provided with two fixed portions 31. The two fixed portions 31 are formed on and extend outward from two opposite sides of the positioning unit 30 respectively. Each of the two fixed portions 31 of the positioning unit 30 is provided with an elongate slot 32. The elongate slot 32 perforates each of the two fixed portions 31. The positioning unit 30 is provided with two locking screws 33. Each of the two locking screws 33 extends through the elongate slot 32 of each of the two fixed portions 31 and is screwed into the guide way 11 of the vise body 10. At this time, each of the two locking screws 33 presses each of the two fixed portions 31 of the positioning unit 30, such that the positioning unit 30 is secured to the vise body 10. Each of the two locking screws 33 has a diameter less than a length of the elongate slot 32 of each of the two fixed portions 31, such that the elongate slot 32 of each of the two fixed portions 31 is movable relative to each of the two locking screws 33. The positioning unit 30 includes a first (or left) positioning block 301 and a second (or right) positioning block 302. The first positioning block 301 and the second positioning block 302 are combined together by screwing. The positioning unit 30 is provided with a positioning groove 34 mounted (or locked) on the positioning flange 21 of the guide screw 20. The positioning groove 34 of the positioning unit 30 has an annular shape. Thus, when each of the two locking screws 33 is unlocked from the elongate slot 32 of each of the two fixed portions 31, the elongate slot 32 of each of the two fixed portions 31 is moved relative to each of the two locking screws 33, and the positioning unit 30 is moved relative to the vise body 10, to exactly micro-adjust a central location of the self-centering vise structure.

In the preferred embodiment of the present invention, the positioning unit 30 is a cuboid lump.

In the preferred embodiment of the present invention, the guide way 11 of the vise body 10 has a bottom face provided with two screw holes 12, and each of the two locking screws 33 is screwed into each of the two screw holes 12 of the vise body 10 to secure the positioning unit 30 to the vise body 10.

Figure 6:
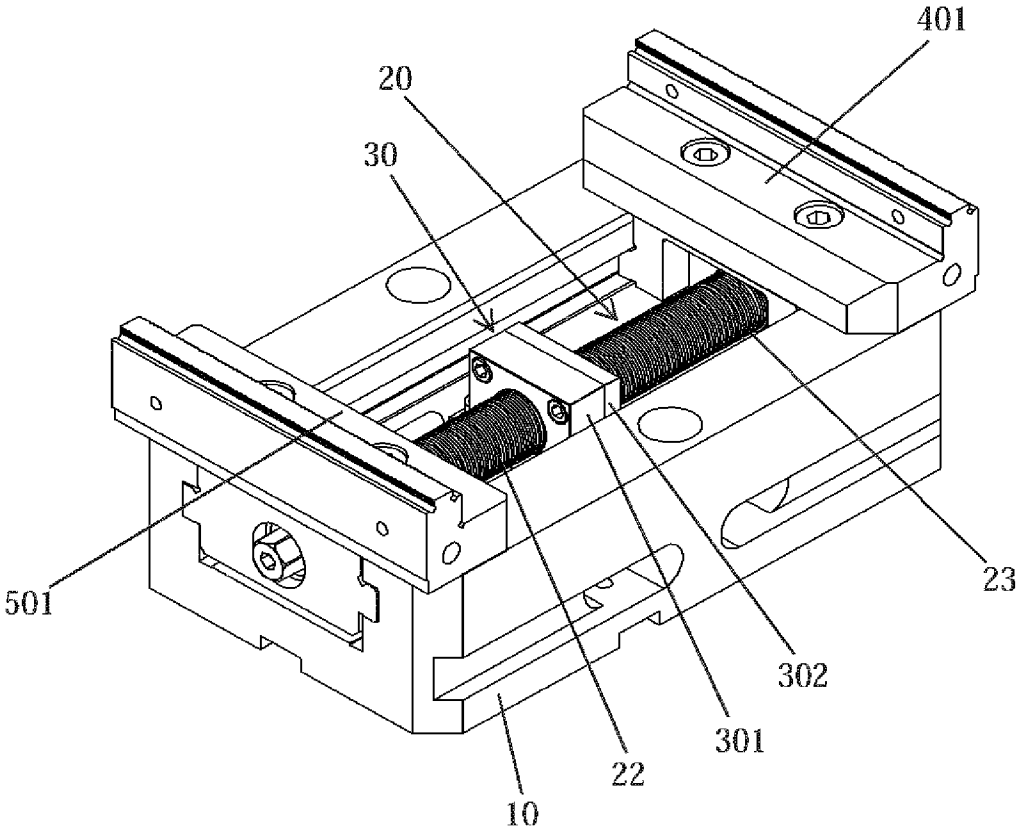
FIG. 6 is a perspective view of the self-centering vise structure in accordance with another preferred embodiment of the present invention, wherein the first movable clamping block and the second movable clamping block are interchanged.

In the preferred embodiment of the present invention, the first movable jaw unit 40 includes a first movable clamping block (or jaw) 401. The first movable clamping block 401 is removably mounted on the first movable jaw unit 40. The second movable jaw unit 50 includes a second movable clamping block (or jaw) 501. The second movable clamping block 501 is removably mounted on the second movable jaw unit 50. The first movable clamping block 401 and the second movable clamping block 501 are interchangeable mutually. Thus, the first movable clamping block 401 is removably mounted on the second movable jaw unit 50, and the second movable clamping block 501 is removably mounted on the first movable jaw unit 40 as shown in FIG. 6.

In brief, the positioning unit 30 is mounted on the guide screw 20 and combined with the vise body 10. After each of the two locking screws 33 is loosened, the positioning unit 30 is moved slightly to micro-adjust the center precision of the self-centering vise structure. After the micro-adjustment is finished, each of the two locking screws 33 is tightened, to finish the center positioning of the self-centering vise structure. Thus, the positioning unit 30 is moved, located and adjusted exactly by provision of the elongate slot 32.

Accordingly, after each of the two locking screws 33 is unscrewed from each of the two screw holes 12 of the vise body 10, the elongate slot 32 of each of the two fixed portions 31 is moved relative to each of the two locking screws 33, such that the positioning unit 30 is moved forward or backward relative to the vise body 10, to exactly micro-adjust the centrality of the self-centering vise structure. In addition, each of the two locking screws 33 is screwed into each of the two screw holes 12 of the vise body 10 to locate the positioning unit 30, and is unscrewed from each of the two screw holes 12 of the vise body 10 to adjust the positioning unit 30, such that the positioning unit 30 is positioned and adjusted easily and rapidly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A self-centering vise structure comprising:

a vise body, a guide screw, a positioning unit, a first movable jaw unit, and a second movable jaw unit;

wherein:

the vise body is provided with a guide way;

the guide screw has a first end provided with a first external thread and a second end provided with a second external thread;

the guide screw has a middle provided with a positioning flange;

the positioning flange has an annular shape;

the positioning unit is mounted on the positioning flange of the guide screw;

the first movable jaw unit is slidably mounted in the guide way of the vise body;

the first movable jaw unit is provided with a first internal thread corresponding to the first external thread of the guide screw;

the second movable jaw unit is slidably mounted in the guide way of the vise body;

the second movable jaw unit is provided with a second internal thread corresponding to the second external thread of the guide screw;

when the guide screw is rotated, the first movable jaw unit and the second movable jaw unit are moved simultaneously to perform a clamping action or a loosening action;

the positioning unit is provided with two fixed portions;

each of the two fixed portions of the positioning unit is provided with an elongate slot;

the positioning unit is provided with two locking screws;

each of the two locking screws initially extends through the elongate slot of each of the two fixed portions and is then screwed into the guide way of the vise body;

the positioning unit includes a first positioning block and a second positioning block;

the first positioning block and the second positioning block are combined together by screwing;

the positioning unit is provided with a positioning groove mounted on the positioning flange of the guide screw;

the positioning groove of the positioning unit has an annular shape; and the elongate slot of each of the two fixed portions is moved relative to each of the two locking screws, and the positioning unit is moved relative to the vise body, to micro-adjust a central location of the self-centering vise structure.

2. The self-centering vise structure as claimed in claim 1, wherein the positioning unit is a cuboid lump.

3. The self-centering vise structure as claimed in claim 1, wherein the guide way of the vise body has a bottom face provided with two screw holes, and each of the two locking screws initially extends through the elongate slot of each of the two fixed portions and then is screwed into each of the two screw holes of the vise body.

4. The self-centering vise structure as claimed in claim 1, wherein:

the first movable jaw unit includes a first movable clamping block;

the first movable clamping block is removably mounted on the first movable jaw unit;

the second movable jaw unit includes a second movable clamping block;

the second movable clamping block is removably mounted on the second movable jaw unit;

the first movable clamping block and the second movable clamping block are interchangeable mutually;

the first movable clamping block is removably mounted on the second movable jaw unit; and the second movable clamping block is removably mounted on the first movable jaw unit.

5. The self-centering vise structure as claimed in claim 1, wherein the two fixed portions are formed on and extend outward from two opposite sides of the positioning unit respectively.

6. The self-centering vise structure as claimed in claim 1, wherein the elongate slot of each of the two fixed portions protrudes outward from the positioning unit.

7. The self-centering vise structure as claimed in claim 1, wherein each of the two fixed portions is located between each of the two locking screws and the vise body.

8. The self-centering vise structure as claimed in claim 1, wherein the elongate slot perforates each of the two fixed portions.

9. The self-centering vise structure as claimed in claim 1, wherein the first positioning block and the second positioning block are combined together by a plurality of second locking screws.

10. The self-centering vise structure as claimed in claim 1, wherein the first positioning block and the second positioning block are located at two opposite sides of the positioning flange of the guide screw.

11. The self-centering vise structure as claimed in claim 1, wherein each of the two locking screws presses each of the two fixed portions of the positioning unit.

12. The self-centering vise structure as claimed in claim 1, wherein each of the two locking screws has a diameter less than a length of the elongate slot of each of the two fixed portions.

* * * * *